United States Patent [19]

Papajewski et al.

[11] 4,052,947

[45] Oct. 11, 1977

[54] ZIGZAG CONTROL DEVICE FOR SEWING MACHINES

[75] Inventors: Reinhold Papajewski, Buchig; Helmer Heinz Holl, Karlsruhe, both of Germany

[73] Assignee: The Singer Company, New York, N.Y.

[21] Appl. No.: 673,826

[22] Filed: Apr. 5, 1976

[51] Int. Cl.[2] ..... D05B 3/02

[52] U.S. Cl. ..... 112/158 R

[58] Field of Search ..... 112/158 R, 158 A, 158 B, 112/158 D, 158 F

[56] References Cited

U.S. PATENT DOCUMENTS

| | | | |
|---|---|---|---|
| 2,047,754 | 7/1936 | Tiesler | 112/158 R |
| 3,094,085 | 6/1963 | Szuba et al. | 112/158 R |
| 3,313,257 | 4/1967 | Hanyu et al. | 112/158 R |
| 3,468,270 | 9/1969 | Moro | 112/158 R |

*Primary Examiner*—Werner H. Schroeder
*Assistant Examiner*—Peter Nerbun
*Attorney, Agent, or Firm*—Edward L. Bell; Robert E. Smith

[57] ABSTRACT

A control device for a zigzag sewing machine is disclosed in which the width of zigzagging and the neutral position of needle vibration may be separately influenced and in which for any given maximum width of zigzag stitching the extreme left and right hand neutral positions of needle vibration can always be made to coincide with the left and right hand sides of that maximum width of zigzag stitching.

4 Claims, 11 Drawing Figures

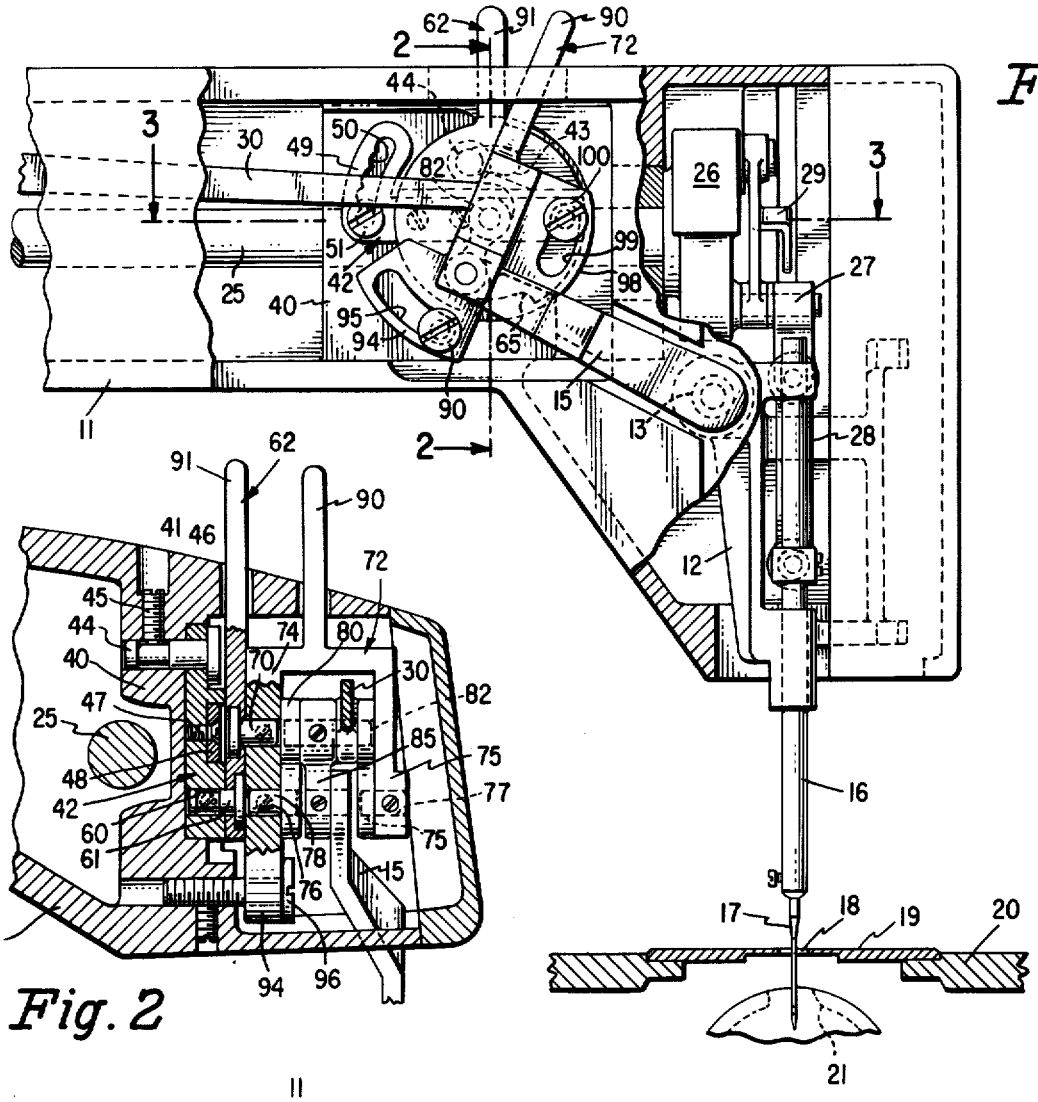
Fig. 1.
Fig. 2
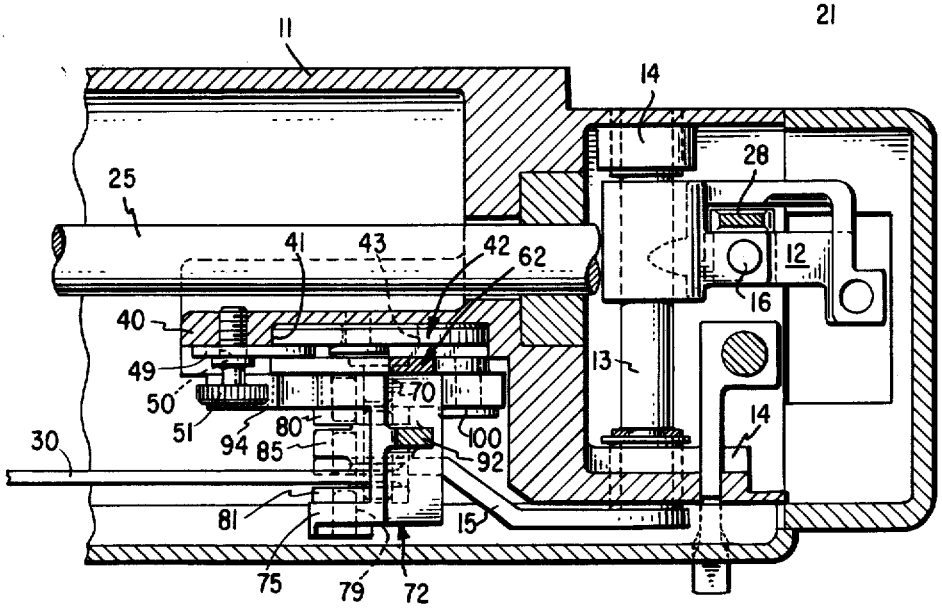
Fig. 3.

Fig. 5.
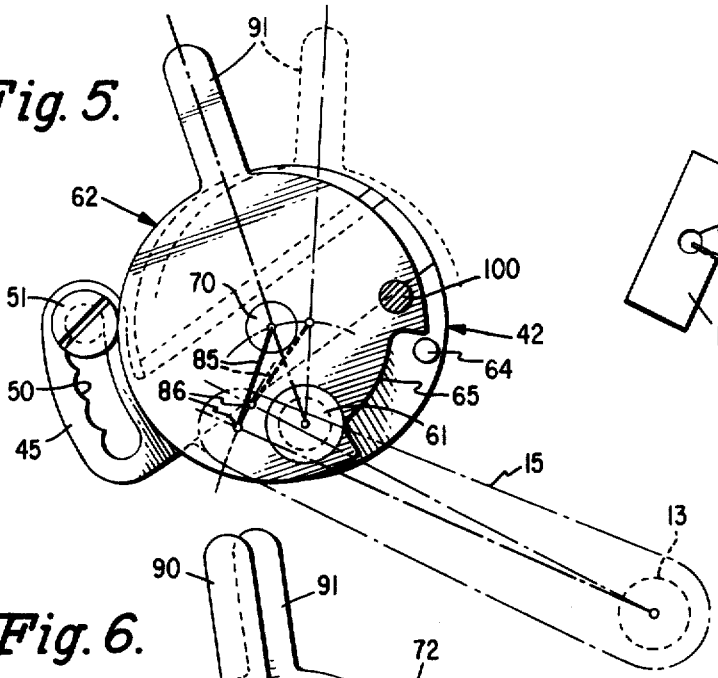
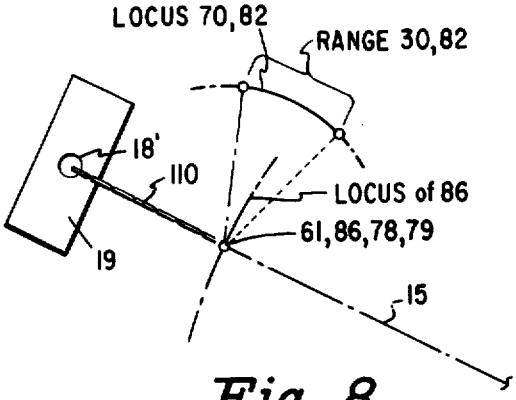
Fig. 8.
Fig. 6.
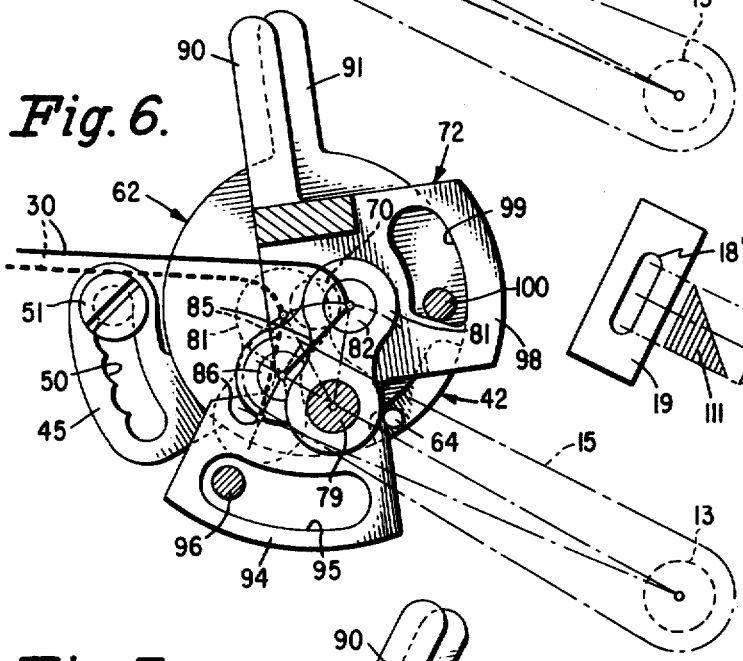
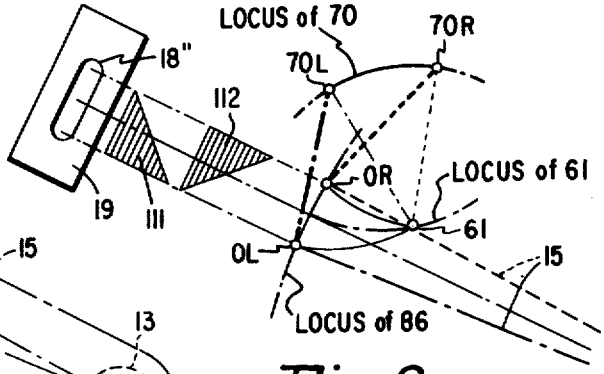
Fig. 9.
Fig. 7.
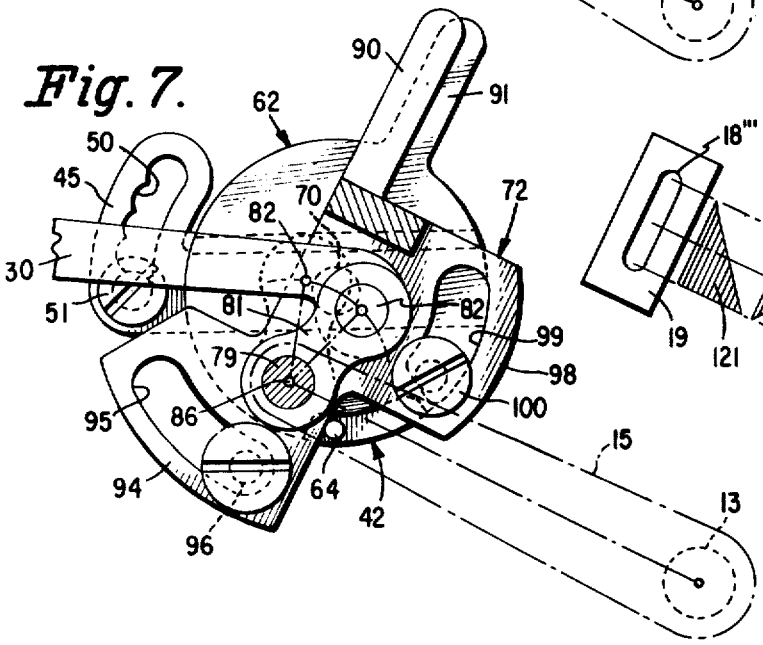
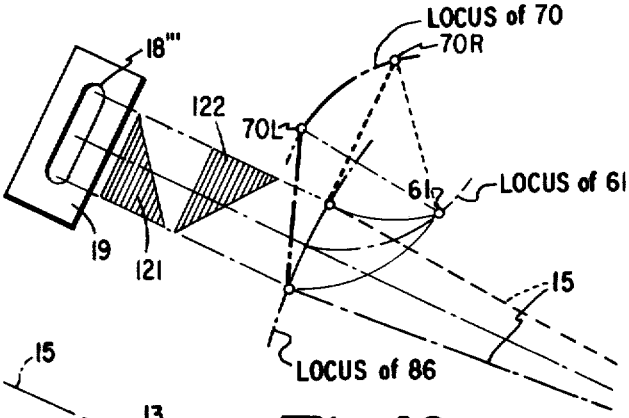
Fig. 10.

ZIGZAG CONTROL DEVICE FOR SEWING MACHINES

BACKGROUND OF THE INVENTION

Other devices are known in zigzag sewing machines in which both the bight and the needle position of needle vibration can be separately adjusted. Reference is made to the U.S. Pat. No. 2,047,754 of Tiesler which discloses such a zigzag control mechanism.

By bight, is meant the width of lateral zigzag motion of the sewing machine needle between successive penetrations. By neutral position of needle vibration, is meant the point within the total possible bight of the needle movement to which the needle will revert when the bight is reduced to zero. Zigzag control mechanisms are usually built so that the neutral position of needle vibration can be set either in the extreme left-hand side of the widest possible bight of zigzag stitching or to the extreme right-hand side thereof, as well as any position intermediate these side extremes. The control for influencing neutral position of needle vibration is sometimes referred to simply as the position control and it is that control which enables the operator to sew straight stitching at either the left, center or right-hand side of the elongated needle aperture in the sewing machine throat plate.

In instances in which a sewing machine will always be fitted with a throat plate having the same size elongated needle aperture sufficient to accommodate the largest possible bight adjustment provided by the control device for the zigzag mechanism, control devices such as disclosed in the above referenced U.S. Pat. No. 2,047,754 are adequate. There are instances, however, particularly in industrial sewing machine usage in which it is required to provide a throat plate with a needle aperture elongated less than that amount which could accommodate the maximum possible bight which the zigzag control mechanism is possible of providing. One possible reason for providing a throat plate with a needle accommodating aperture having a width less than the possible maximum value would be to minimize flagging of the work which the wider needle aperture would occasion in instances in commercial usage in which only narrow zigzag stitches are required. If under these circumstances a control mechanism of the Tiesler U.S. Pat. No. 2,047,754 were to be used, a difficulty would be experienced in that the left and right hand settings of the neutral position of needle vibration control cannot be made to occur at the extreme left and right hand extremities of the needle accommodating aperture in the throat plate. This is so in known zigzag mechanisms because from any setting of the position control other than its extreme left or right settings, the zigzag width and bight will grow in both left and right hand directions as the bight control is advanced from zero bight setting. If, therefore, a device such as the Tiesler U.S. Pat. No. 2,047,754 teaches were to be used with a throat plate having a slot less than that which is able to accommodate the total maximum bight possible, skewed patterns of zigzag stitches will result in which the needle cannot be made to sew straight stitches in the extreme left and right hand positions.

SUMMARY OF THE INVENTION

It is an object of this invention to provide a control device for a zigzag sewing machine in which neutral position of needle vibration can be made to occur at the extreme left and right hand edges of zigzag sewing regardless of the total width of zigzagging which may possibly be produced. This object of the invention is attained by the provision of a third control element in addition to the usual needle position and bight control elements, which third control element simultaneously influences not only the effect of the position adjusting control element but also the width of zigzag stitching which may be set by the bight adjusting control element to effect the above described results.

DESCRIPTION OF THE DRAWINGS

In the accompanying drawings of a preferred embodiment of the invention,

FIG. 1 represents an elevational view of a fragment of a zigzag sewing machine with the portions thereof broken away to illustrate a zigzag control device of this invention applied thereto, FIG. 2 is a cross-sectional view of the bracket arm of the sewing machine of FIG. 1 taken substantially along line 2—2 thereof, FIG. 3 is a cross-sectional view taken substantially along line 3—3 of FIG. 1, FIG. 5 is an enlarged elevational view of a portion of the zigzag control mechanism taken from the same viewpoint as seen in FIG. 1 and showing the parts in that position of adjustment for providing for the maximum possible bight which the mechanism is capable of producing, FIG. 6 is a view similar to FIG. 5 but with additional parts of the zigzag control mechanism included, FIG. 7 is an elevational view of the zigzag control mechanism similar to FIG. 6 but showing the position of the parts adjusted to satisfy a condition of zero bight, FIG. 8 is a diagrammatic representation of the locus of positions of various parts of the mechanism of this invention when the parts are adjusted to a zero bight setting as illustrated in FIG. 7, FIG. 9 is a diagrammatic representation similar to FIG. 8 showing the conditions which exist in this mechanism when the parts are adjusted to accommodate approximately half the total possible bight which the mechanism is capable of producing, FIG. 10 is a diagrammatic representation similar to FIG. 8 showing the conditions which exist in this mechanism when the parts are adjusted to accommodate the maximum possible bight.

DESCRIPTION OF THE PREFERRED EMBODIMENT

Figure 4:
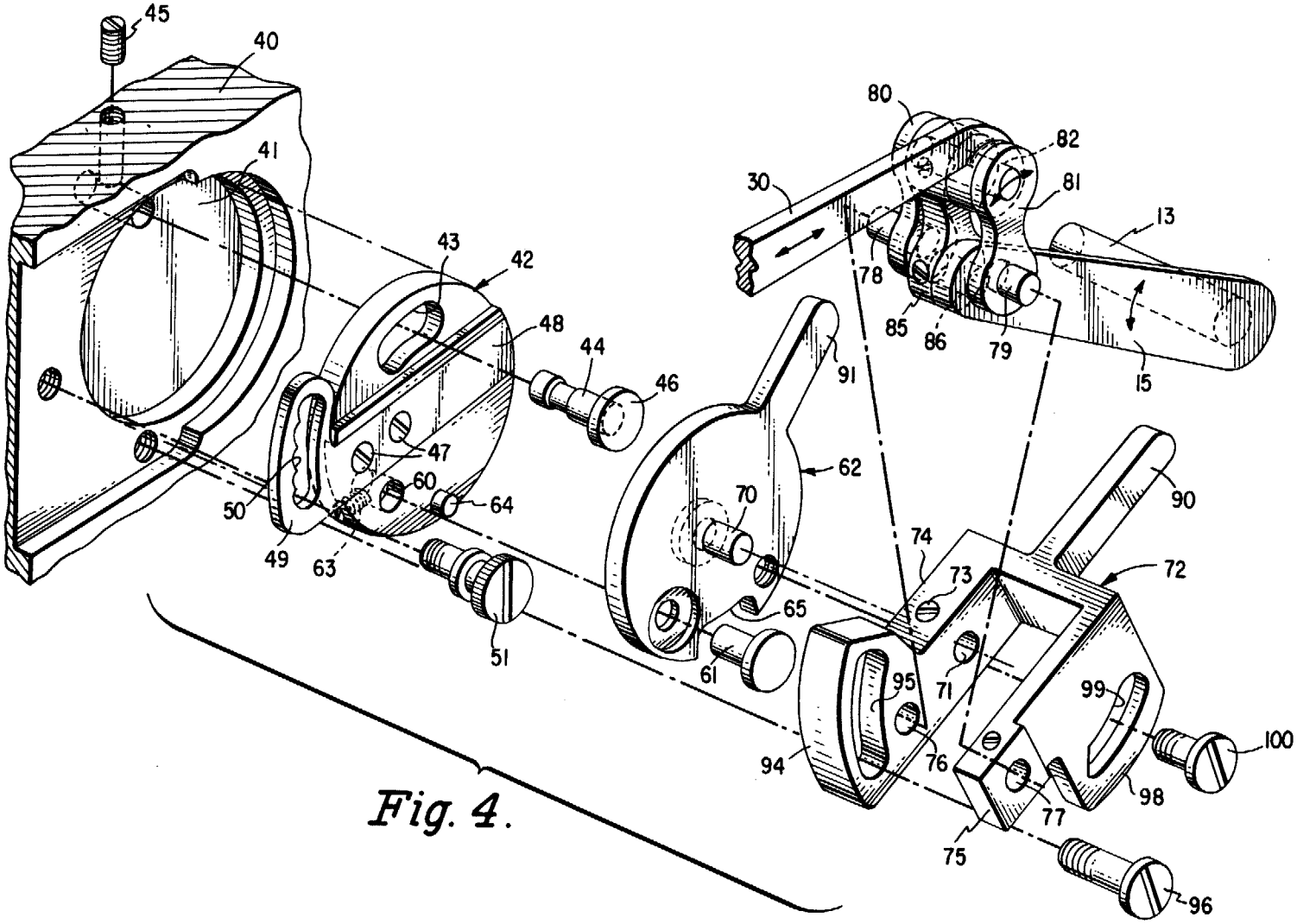
FIG. 4 is an exploded perspective view of the control mechanism of this invention.

Referring to the drawings; FIG. 1 indicates the bracket arm of a sewing machine in which a needle bar carrying gate 12 is accommodated. The gate is secured to a trunnion pin 13 which is journaled in bearing bosses 14 in the bracket arm 11. A driven arm 15 is secured to the trunnion pin 13 so that angular movement of the driven arm will be reflected in the swinging movement of the needle bar carrying gate 12 to impart lateral jogging movement to a needle bar 16 which is endwise reciprocable in the gate 12. As shown in FIG. 1 a needle 17 which is secured to the needle bar moves through an elongated aperture 18 in a throat plate 19 carried on the sewing machine bed 20 into cooperative relation in the formation of stitches with a loop taker 21 arranged in the bed.

A rotating shaft 25 in the bracket arm 11 carries a counterbalance 26 and a drive crank 27 which is embraced by a drive link 28 for imparting endwise reciprocable movement to the needle bar as well as cyclic movement to a needle thread take-up device indicated generally at 29.

For imparting lateral jogging movement to the needle bar, a zigzag drive member 30 is provided in the sewing machine bracket arm 11 which drive member may take any one of a variety of known forms, it being significant only that the zigzag drive member must have imparted to it a recurring movement of substantial constant throw in timed relation preferably one half the frequency of rotation of the shaft 25. In the preferred embodiment illustrated in the drawings, the zigzag drive member is imparted reciprocable movement lengthwise of the sewing machine bracket arm 11 of substantially constant throw as, for instance, in response to an eccentric, cam, or the like (not shown). The control device of this invention, which will be now described in detail, serves to regulate the proportion of the constant movement of the zigzag drive member 30 which is transmitted to the driven arm 15 as well as the position of the driven arm 15 during the transmission thereto of such motion.

The bracket arm 11 is preferably provided with a vertical web 40 in which a circular recess 41 is formed and in which a width limiting member 42 is freely journaled. An arcuate slot 43 in the width adjusting member accommodates a guide pin 44 held in the web 40 by a set screw 45 so that an enlarged head 46 on the guide pin 44 will constrain the width limiting member within the circular recess 41. Secured to the width limiting member 42 as by screws 47 is a radial bracket 48 beyond the width limiting member with an enlarged bracket arm 49 in which an arcuate slot 50 is formed which accommodates a clamp screw 51 threaded into the web 40 and by which the width limiting member may be clamped to the machine frame in any one of a range of positions of adjustment in the circular recess 41.

The width limiting member 42 is formed with a bore 60 spaced radially from the center or axis of turning movement defined by the circular recess 41. The bore 60 is adapted to accommodate a headed fulcrum pin 61 on which a position adjusting member 62 is pivotally supported. The fulcrum pin may be secured in the width limiting member bore 60 by a set screw 63. A stop pin 64 carried in the width limiting member serves in abutting a recess notch 65 in the position adjusting member to limit adjustment of the position adjusting member in one direction.

The position adjusting member 62 carries a fulcrum pin 70 accommodated in a bore 71 formed in a bight adjusting member 72 so that the fulcrum pin 70 provides the center about which the bight adjusting member is supported for pivotal movement. Preferably the fulcrum pin 70 is headed and a set screw 73 in the bight adjusting member is used to secure the bight adjusting member thereto. Preferably the bight adjusting member 72 is formed with bifurcate arms 74 and 75 which are formed each with one of the aligned bores 76 and 77. The bores 76, 77 are each adapted to accommodate one of the control pivots 78, 79 of a pair of identical anchor links 80 and 81. The anchor links 80 and 81 each embrace at the other extremity a common pivot pin 82 secured in the zigzag drive member 30.

The common pivot pin 82 joining the anchor links with the zigzag drive member is also embraced by a motion transmitting link 85 which is pivoted by a pin 86 to the driven arm 15 associated with the needle bar carrying gate 12. Together, the motion transmitting link 85 and the anchor links 80 and 81, or either of them, constitute a toggle device so that the position of the control pivots 78 and 79 in determining the path of movement of the common pivot pin 82 in response to the constant throw of the zigzag drive member 30 determine the magnitude of motion which will be transmitted to the driven arm 15. Thus when the control pivots 78, 79 are disposed substantially in alignment with the pin 86 or on a line perpendicular to the driven arm 15 and passing throught the axis of the pin 86, the movement of the common pivot pin 82 will be in a circular path about the axis of the pin 86 and no motion at all will be transmitted to the needle bar carrying gate; the bight in this position of adjustment will be zero and the position of the control pivots 78, 79 along the previously described perpendicular line will determine where within the elongated needle accommodating slot in the throat plate the needle will penetrate either left, center or right therein.

The bight adjusting member 72 which may be provided with a handle 90 generally serves to adjust the control pivots 78, 79 relatively to the line perpendicular to the driven arm 15 and passing through the connecting pin 86 for adjusting the width of zigzag stitching. The position adjusting member 62 which may be provided with a handle 91, generally serves to shift the position of the control pivots 78, 79 along or relatively to the above described perpendicular line so as to influence the position left, center or right within the field of zigzagging at which the needle will gravitate when the bight is reduced to zero. In FIGS. 1 and 2 of the drawings, the handles 90 and 91 are illustrated as projecting out of the bracket arm 11 and it will be understood that any known stop or setting device may be applied (not shown) for locking the position adjusting member 62 and the bight adjusting member 72 in selected positions of adjustment.

The bight adjusting member 72 is provided with an extension 94 of the bifurcated arm 74 in which extension an arcuate slot 95 is formed accommodating a stop crew 96 which is threaded into the web 40 of the sewing machine bracket arm. An extension 98 of the bifurcated arm 75 of the bight adjusting member 72 is formed with an arcuate slot 99 which accommodates a shouldered stop screw 100 which is fastened in the position adjusting member 62. By virtue of the stop screw 100 in the arcuate slot 99 the bight adjusting member 72 will be restricted as to possible excursion as the width limiting member 42 is adjusted in the circular recess 41 of the machine frame web 40 so that adjustments of the width limiting member 42 of this invention will simultaneously influence the effect of adjustment of the position adjusting member 62 and at the same time regulate the total possible excursion of the bight adjusting member 72, and it is by this simultaneous influence of the adjusting members 62 and 72 that the objects of this invention are attained.

Referring now to the diagrammatic representations in FIGS. 8–11, the operation of this invention will now be described. When the width limiting member 42 is set into the position as illustrated in FIG. 7 and the clamp screw 51 is fixed at the bottom of the arcuate slot 50, the fulcrum pin 61 of the position adjusting member will be arranged substantially coincident with the pin 86 in the driven arm 15. The locus of possible positions for the fulcrum pin 70 on which the bight adjusting member 72 is carried will, therefore, occur on a circular line having its center coincident with the pin 86 and therefore adjustments of the position adjusting member 62 will have no influence whatever on the needle bar carrying gate. As shown in FIG. 7, this position of adjustment of parts will also carry the stop screw 100 against the extremity 101 of the arcuate slot 99, while the stop screw 96 occupies a position against the extremity of the arcuate slot 95 and thus the bight control member 72 will be locked in a position in which the control pivots 78, 79 are also coincident with the pin 86 in the driven arm 15. The locus of positions for the common pivot pin 82 in the zigzag drive member 30 thus also occurs on a circular path having its center at the pin 86 and therefore no zigzag movement will be imparted to the needle bar carrying gate and in this position of parts, a straight line of stitches will be sewn by the machine with the needle penetrating the center of any needle accommodating aperture which is formed therein. In FIG. 8 this condition is illustrated by a representation of a straight line of stitches 110 being formed from a circular needle aperture 18' in a representation of the throat plate drawn alongside FIG. 8.

In FIG. 9 a diagrammatic representation is provided of the position of the various parts when the clamp screw 51 is set centrally of the arcuate slot 50 of the width limiting member 42. It is to be noted in FIG. 9 that the location of fulcrum pin 61 for the position adjusting member 62 is to the right of the locus of positions for the pin 86 in the driven arm 15 and, therefore, the locus of possible positions for the pivot pin 70 for the bight adjusting member does not have its center coincident with the pin 86. In FIG. 9 the extreme left hand position setting for the pivot pin 70 is labeled 70L and dot and dashed lines indicate the extreme positions of adjustment of bight adjusting member 72, the zero bight setting being indicated by the reference character OL. The extreme right hand position of adjustment for the pivot pin 70 is labeled 70R and dotted lines indicate the extreme positions of adjustment of the bight adjusting member 72, the zero bight setting being indicated by the reference character OR. FIG. 9 also includes a representation of the throat plate 19 with an intermediate elongated needle aperture 18". As shown in FIG. 9, the neutral position of needle vibration in the extreme left and right settings occurs at the left and right hand edges of the field of zigzag stitching; stitches 111 indicate a left-hand position setting and stitches 112 indicate a right-hand position setting.

In FIG. 10, a diagrammatic representation is provided similar to that of FIG. 9, but in a position of the parts when the clamp screw 51 is set at the top of the arcuate slot 50 of the width limiting member 42 as shown in FIGS. 5 and 6. As shown in FIG. 10, the location of the fulcrum pin 61 for the position adjusting member 62 is further to the right of the locus of positions for the pin 86 in the driven arm 15 than in the position of parts illustrated in FIG. 9. The locus of possible positions for the pivot pin 70 for the bight adjusting member, therefore occurs in FIG. 10 at a greater angle to the locus of possible positions for the pin 86. In FIG. 10, the position of adjustment of the pivot pin 70 in the extreme left hand setting of member 62 is labeled 70L. In the of parts shown in FIG. 10 the widest possible distance will be obtained beyond the extreme left hand and extreme right hand neutral positions of needle vibration. This is illustrated in FIG. 10 by the representation of a throat plate 19 with the widest possible needle aperture 18'''. It will be noted that in this position of parts the neutral positions of needle vibration in the extreme left and right settings similarly occur at the extreme right and left hand edges of the total field of zigzag stitching, stitches 121 indicate a left-hand setting and stitches 122 indicate a right-hand position setting.

Figure 11:
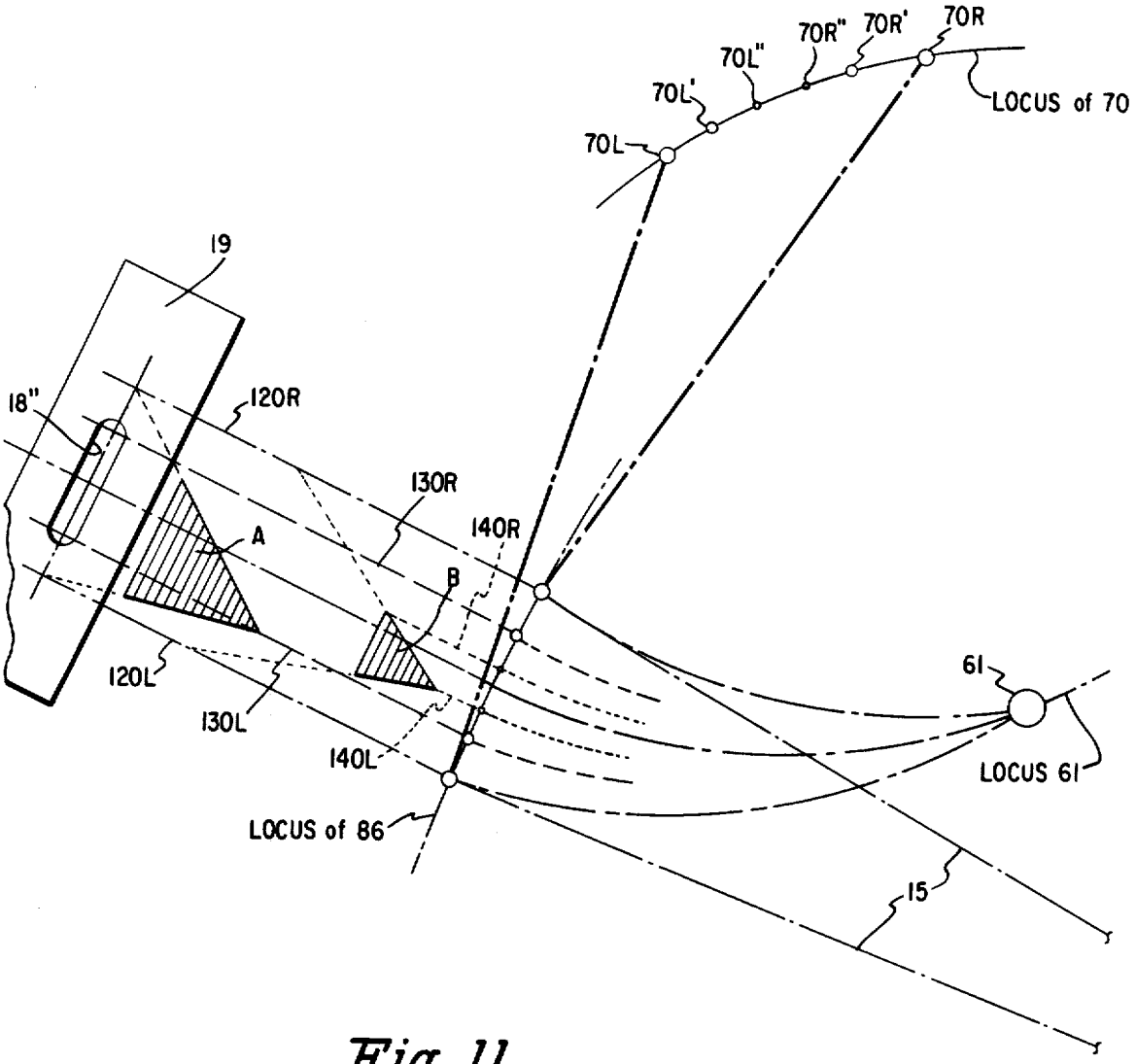
FIG. 11 is an enlarged diagrammatic representation similar to that of FIG. 10 but illustrating the undesirable result which is obtained when accommodation of a smaller width of needle aperture is attempted simply by setting of the position and bight regulators without resort to the present invention.

FIG. 11 is a view similar to FIG. 10, in other words, a diagrammatic representation of the condition which is obtained when the clamp screw 51 is set at the top of the arcuate slot 50 of the width limiting member 42 providing for accommodation of the widest possible bight which is obtainable. FIG. 11 illustrates the result which would be obtained if attempts were to be made to accommodate a needle aperture 18" in the throat plate 19 which is narrower than the maximum bight which could be produced by the mechanism simply by limiting the range of adjustment of the position adjusting member 62 and bight adjusting member 72. The position of the fulcrum pin 61 will remain the same as in the position of adjustment shown in FIG. 10 as will the locus of possible positions for the fulcrum pin 70. In order to keep the needle penetration within the needle aperture 18" or FIG. 11, however, the range of adjustment of the position adjusting member 62 must be curtailed. Note in FIG. 11 that if the range of adjustment of the position adjusting member 62 is not curtailed, then the extreme positions of the fulcrum pin 70 which are indicated at 70L and 70R will dictate neutral positions of needle vibration left and right respectively which are shown in dot-dash lines 12QL and 12OR in FIG. 11 and occur outside the length of the narrowed needle aperture 18".

In FIG. 11, the curtained positions of the fulcrum pin 70 which are indicated by the reference characters 70L' and 70R' will bring the left and right hand neutral positions of needle vibration within the foreshortened needle aperture 18". These left and right hand straight stitch positions are illustrated in dashed lines 130L and 130R. However, further curtailment of the range of position adjusting member 62 would be necessary for another reason now to be explained.

If the neutral positions of needle vibration is set at the extreme left and right hand ends of the needle aperture 18", i.e., along lines 130L and 130R, then as the bight is increased the pattern will spread on both sides of these neutral positions. Such a pattern is indicated at A in FIG. 11 for the left hand neutral position 130L and it will be apparent that this cannot be tolerated because the needle will be jogged beyond the end of the needle aperture 18".

In order to avoid needle jogging beyond the limits of a foreshortened needle aperture 18" while the jogging mechanism is set to accommodate the maximum bight, the neutral position of needle vibration must be further curtailed, for instance, to the positions shown in dot and dashed lines 140L and 140R in FIG. 11 by limitation of the position adjusting member 62 settings so that the fulcrum pin 70 can be set only between the positions 70L" and 70R". The resulting pattern of possible zigzag stitches proceeding from a neutral position along dotted line 122L is indicated at B. It will be further noted that the bight must also be drastically limited. In other words, using prior art mechanisms the left and right positions of straight stitching 140L and 140R cannot be made to occur at the extreme left and right hand ends of the needle aperture 18" unless the needle aperture is made wide enough to accommodate the widest zigzag stitch which the mechanism is capable of producing.

With the present invention as shown in FIGS. 8, 9, and 10, regardless of the width of needle aperture 18, the needle position and the left and right extremes can always be located at the edges of the field of zigzag sewing and the patterns of stitches, although narrowed, will always have the same traditional form.

Having set forth the nature of this invention, what is claimed here is:

1. A zigzag control mechanism for a sewing machine having a needle bar supported for lateral zigzag movement, said zigzag control mechanism comprising a bight adjusting member (72) for controlling the width of zigzag stitching, a position adjusting member (62) for controlling neutral position within the range of zigzag movement at which straight stitches will be formed when the width of zigzag stitching is reduced to zero by the bight adjusting member, and a width limiting member (42) for limiting the width of zigzag stitching which may be set by said bight adjusting member (72) and for simultaneously effecting that adjustment of the position adjusting member (62) which will locate the neutral position of needle vibration at the extreme left and right hand edges of zigzag sewing regardless of the total width of zigzagging.

2. A zigzag control mechanism for a sewing machine of the type having a frame (11), needle bar carrying gate (12) shiftably supported on said frame for lateral zigzag movement and having a driven arm (15), a zigzag drive member (30) in said frame having a substantially constant throw, a motion transmitting connection (85) between said zigzag drive member and a pivot pin (86) on said driven arm, and a toggle device provided for regulating the transfer of motion from said zigzag drive member to said needle bar gate, said toggle device including an anchor link (80) or (81) pivoted at one extremity (82) with respect to said zigzag drive member and having at the other extremity a control pivot (78), (79) which may be selectively positioned into or out of coincidence with a line through the axis of said pivot pin (86) on said driven arm and perpendicular to said driven arm 15 of said needle bar carrying gate (12), the improvement which comprises three interconnected control members for regulating the disposition of said control pivot (78), (79) and including a width limiting member (42) pivoted to turn on an axis in said frame, a position adjusting member (62) pivotally supported on said width limiting member (42) at a point (61) spaced from the turning axis of said width limiting member which pivotal support (61) for said position adjusting member is movable into and out of coincidence with said line through the axis of the pivot pin on said driven arm and perpendicular to said driven arm of said needle bar carrying gate, and a bight adjusting member (72) pivotally supported at (70, 71) on said position adjusting member 62 and carrying said anchor link control pivot (78, 79,) and cooperating stop abutment means (99, 100) on said position and bight adjusting members for limiting the excursion of said bight adjusting member (72) from the zero bight position in direct proportion to the amount by which said pivotal support (61) for said position adjusting member is moved away from said line through the axis of the pivot pin on said driven arm and perpendicular to said driven arm of said needle bar carrying gate by turning movement of said width limiting member (42).

3. A zig zag control mechanism as set forth in claim 2 in which said cooperating stop abutment means (99), (100) on the position and bight adjusting members comprise an arcuate slot (99) formed in one of said adjusting members and an abutment pin (100) carried in the other of said members, said cooperating stop abutment means being arranged to lock said bight adjusting member in a position of zero bight when said pivotal support for said position adjusting member occupies a position substantially coincident with a line through the axis of the pivot pin on the driven arm and perpendicular to said driven arm.

4. A zigzag control mechanism as set forth in claim 2 in which the motion transmitting connection between the zigzag drive member (30) and the driven arm (15) of the needle bar carrying gate comprises a motion transmitting link (85) pivoted (82) to the zigzag drive member and embracing the pivot pin (86) on said driven arm, and in which the distance between said pivotal connections on said motion transmitting link is substantially equal to a. the distance on said width limiting member between the axis of turning movement and the pivotal support (61) for the position adjusting member, b. the distance on said position adjusting member (62) between the pivotal support (61) thereof and pivotal support (70) for said bight adjusting member and c. the distance on said bight adjusting member 72 between the pivotal support (70, 71) thereof and said anchor link control pivot (78, 79).

* * * * *